US007658221B2

(12) United States Patent
Wobker et al.

(10) Patent No.: US 7,658,221 B2
(45) Date of Patent: Feb. 9, 2010

(54) PERMANENT CHILL MOLD

(75) Inventors: Hans-Günter Wobker, Bramsche (DE); Gerhard Hugenschütt, Belm (DE)

(73) Assignee: KM Europa Metal Aktiengesellschaft, Osnabruck (DE)

( * ) Notice: Subject to any disclaimer, the term of this patent is extended or adjusted under 35 U.S.C. 154(b) by 0 days.

(21) Appl. No.: 11/637,460

(22) Filed: Dec. 11, 2006

(65) Prior Publication Data

US 2007/0131380 A1 Jun. 14, 2007

(30) Foreign Application Priority Data

Dec. 12, 2005 (DE) ..... 10 2005 059 712

(51) Int. Cl.
*B22D 11/04* (2006.01)
*B22D 11/055* (2006.01)

(52) U.S. Cl. ..... 164/443; 164/418

(58) Field of Classification Search ..... 164/418, 164/459, 435, 443, 348, 485
See application file for complete search history.

(56) References Cited

U.S. PATENT DOCUMENTS 3,749,152 A * 7/1973 Dore et al. ..... 164/420
4,658,884 A * 4/1987 Euler et al. ..... 164/443
5,409,053 A * 4/1995 Kawa et al. ..... 164/418

* cited by examiner

*Primary Examiner*—Kevin P Kerns
(74) *Attorney, Agent, or Firm*—Kenyon & Kenyon LLP

(57) ABSTRACT

A permanent chill mold for the continuous casting of metals, comprising a mold tube (1) placed in a water box, a water gap being formed between the inner side of the wall of the water box and the outer side (2) of the mold tube (1). In the water gap, at least one sheet metal water deflector (3) is situated, the mold tube (1) being supported at least in one direction to be laterally freely shiftable with respect to the water box and the working position of the mold tube (1) being adjusted by the flow relationships in the water gap.

19 Claims, 2 Drawing Sheets

PERMANENT CHILL MOLD

BACKGROUND OF THE INVENTION

1. Field of the Invention

The invention relates generally to a permanent chill mold for the continuous casting of metals.

2. Description of Related Art

Tube-shaped chill molds made of copper or copper alloys, for casting profiles made of steel or other metals having a high melting point have been described many times in the related art. Mold tubes are cooled by cooling water, in this context, which flows through a water gap between the inner side of the wall of a water box surrounding the mold tube and the outer side of the mold tube. Normally, the mold tube is correctly aligned in the water box, by adjusting screws, in such a way that the desired width of the water gap around the outside of the mold tube sets in. Since the mold tube is submitted to extreme thermal stresses, the exact alignment of the mold tube in the water box must be made very carefully, so that different flow speeds do not occur, based on different widths of the water gap, and with that, differently great heat dissipation. This would result in different strand shell growth and differently severe shrinkages. This, in turn, could lead to material stresses and cracks in the strand shell, which increases the risk of a strand break-out.

SUMMARY OF THE INVENTION

It is an object of the invention to provide a liquid-cooled permanent chill mold for the continuous casting of metals, in which the alignment of the permanent chill mold inside the water box is simplified.

This and other objects of the invention are achieved by a permanent chill mold for the continuous casting of metals having a mold tube (1) placed in a water box, a water gap being formed between the inner side of the wall of the water box and the outer side (2) of the mold tube (1), wherein in the water gap, at least one sheet metal water deflector (3) is situated, the mold tube (1) being supported at least in one direction to be laterally freely shiftable with respect to the water box and the working position of the mold tube (1) being adjusted by the flow relationships in the water gap.

BRIEF DESCRIPTION OF THE DRAWINGS

The present invention will be described in greater detail with reference to the following drawings wherein.

DETAILED DESCRIPTION OF THE INVENTION

In accordance with the invention there is at least one sheet metal water deflector situated in the water gap of the permanent chill mold. The sheet metal water deflector leads to cross sectional changes in the water gap, the cross sectional changes resulting in a change of the flow speed. Since the mold tube is supported to be freely shiftable in one direction with reference to the water box, the working position of the mold tube is able to set itself by the flow relationships in the water gap. The mold tube is thereby correctly aligned in the water box in a self-centering manner.

The self-centering is achieved in having the hydrodynamic forces in the water gap mutually compensating for one another. If the width of the water gap becomes greater on one side of the mold tube, for example, the flow speed decreases in this region. The hydrodynamic force, which acts on the outer wall of the mold tube, likewise decreases in this region. To the same extent, the reduction in the width of the water gap on the opposite side of the mold tube leads to an increase in the flow speed, whereby in this region, greater hydrodynamic forces set in which, based on the laterally freely shiftable mold tube, have the effect that the mold tube is shifted slightly, until a force equilibrium is again established. The sheet metal water deflectors are therefore situated in respectively opposite regions of the mold tube or of the water gap.

It is particularly regarded as expedient if at least one partial region of the outer surface of the mold tube is provided with cooling channels, the sheet metal water deflector being situated in the region of the cooling channels. In the case of a water gap of constant cross section, the flow cross section increases in the region of the cooling channels, which leads to a reduction in the flow speed. In order to convey cooling water through the cooling channels at high speed, it is provided that the sheet metal water deflector diminishes the flow cross section in the region of the cooling channels, at least from region to region. For this, the sheet metal water deflector has a diversion section at its end which is developed so that cooling water is conveyed from the water gap specifically into the cooling channels. The diversion section is configured to favor the flow, so that as little turbulence as possible forms in the cooling means gap. The diversion section is expediently configured to be arched.

According to one specific embodiment, the flow speed in the inflow region and the outflow region of the cooling channels is increased by the sheet metal water deflector. The local increases in the flow speed also lead to a rise in the hydrodynamic forces in this region. It is favorable if the regions of increased flow speed are situated diametrically at the same height of the mold tube. All the sheet metal water deflectors are therefore preferably configured to be identical.

Figure 1:
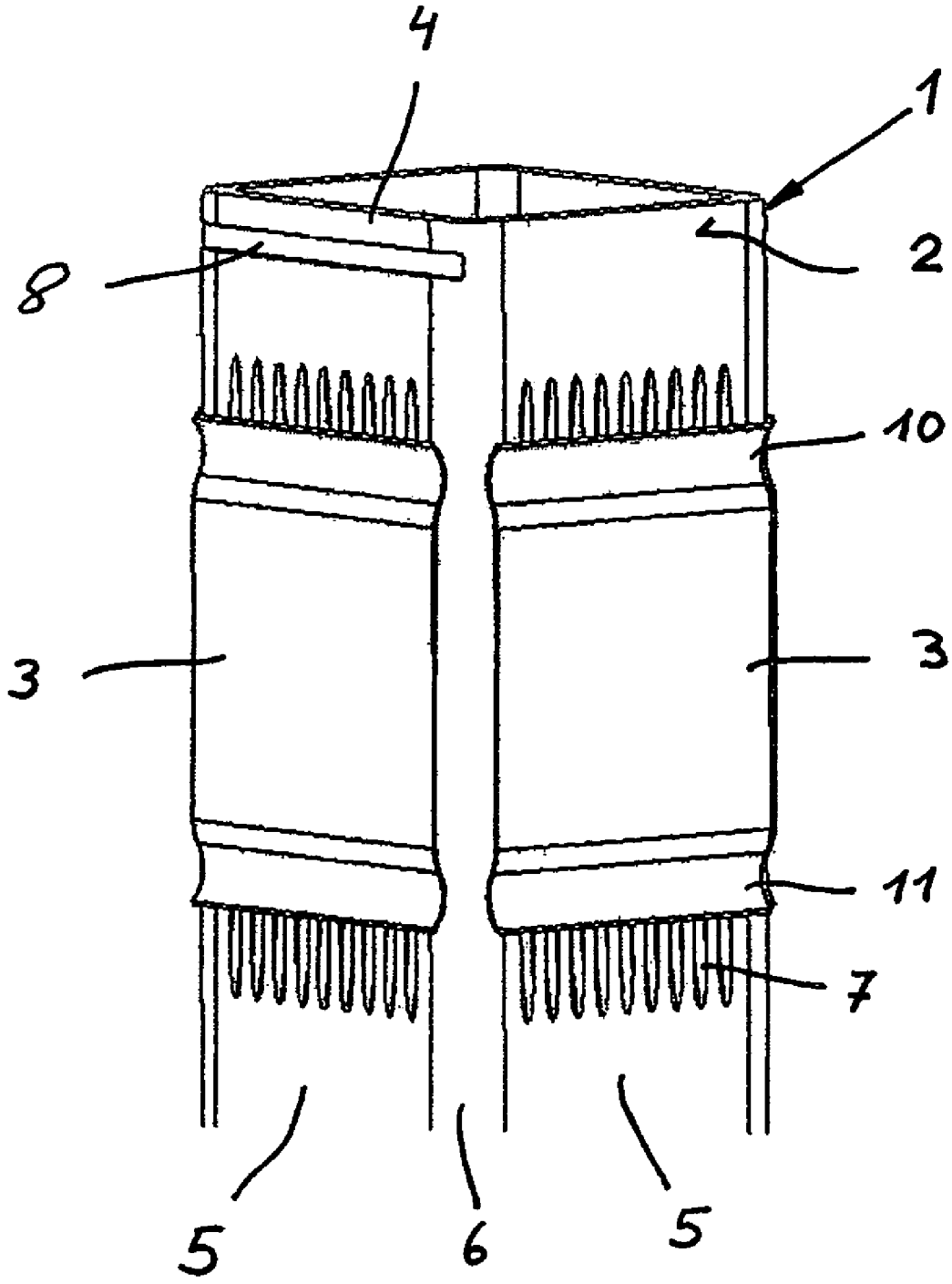
FIG. 1 shows a mold tube 1 of rectangular cross section, which is placed in a water box that is not shown.

FIG. 1 shows a mold tube 1 of rectangular cross section, which is placed in a water box that is not further shown. Mold tube 1 is liquid-cooled from the outside, a water gap being developed between the inner side of the wall of the water box and the outer side 2 of mold tube 1. Sheet metal water deflectors 3 shown are situated in this water gap.

Figure 2:
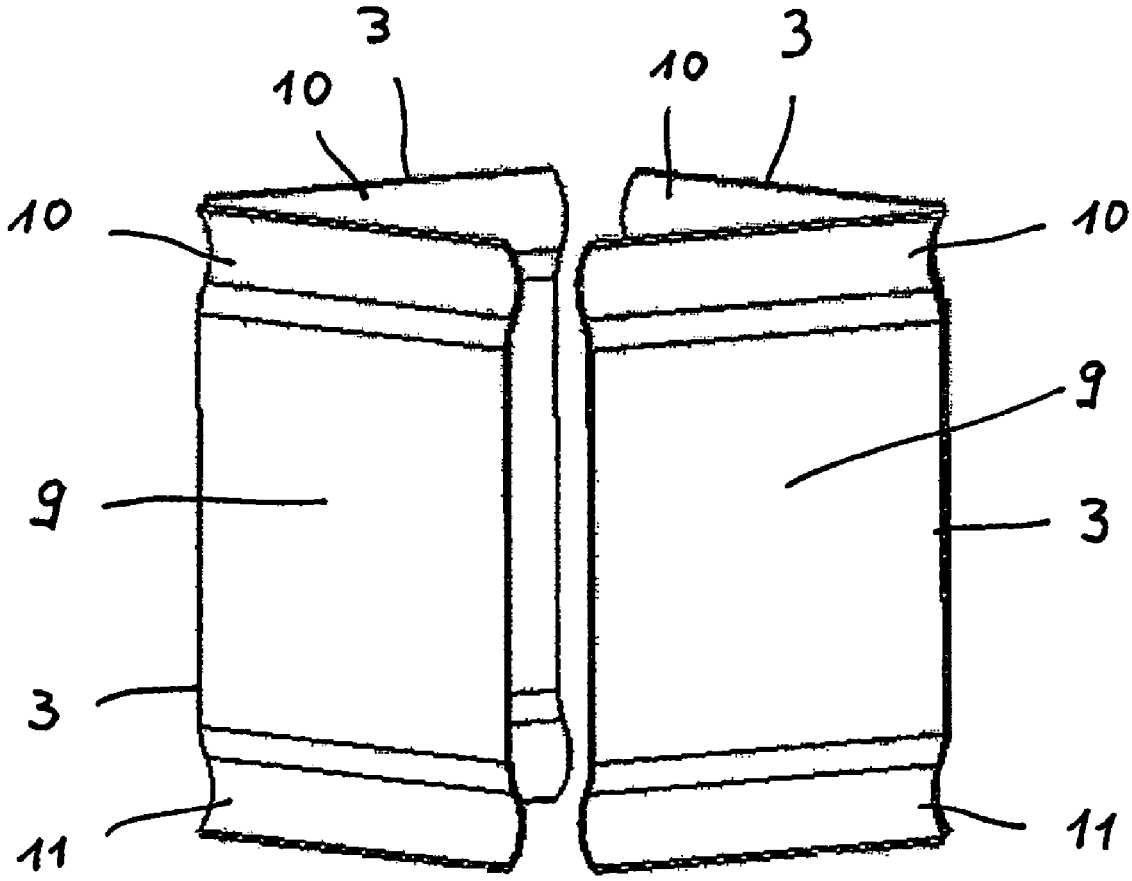
FIG. 2 is a perspective view of sheet metal water deflectors 3 which are easily recognized in their spatial situation.

FIG. 2 is a perspective view of sheet metal water deflectors 3 which are easily recognized in their spatial situation. In this exemplary embodiment, four sheet metal water deflectors 3 are provided, two sheet metal water deflectors 3 always lying opposite to one another at the same height. Sheet metal water deflectors 3 are configured to be identical, and extend nearly over the entire width of a sidewall 5 of mold tube 1, the corner regions 6 being recessed.

In FIG. 1 it may be seen that a partial region of outer sides 2 of the mold tube is provided with a cooling channel 7 that extends in the flow direction. Cooling channels 7 do not extend over the entire length of mold tube 1, but exclusively in the region of the casting bath level setpoint position, since in this region the greatest heat flow densities occur, and a correspondingly intensive cooling of mold tube 1 is required. Cooling channels 7 lead to an enlargement of the cooling surface, so that heat transfer into the cooling water is simplified. Sheet metal water deflectors 3 are placed in the region of cooling channels 7, sheet metal water deflectors 3 being a little shorter than cooling channels 7. This means that cooling channels 7 extend beyond sheet metal water deflector 3 both in their inflow region and their outflow region. Furthermore, a guiding channel 8 may be seen in FIG. 1 at upper end 4 of mold tube 1, by which mold tube 1 is held to the water box that is not shown in detail, in the vertical direction. Guiding channel 8 is configured so that a shift laterally to the flow direction of the cooling water is made possible.

Sheet metal water deflectors 3 are configured to be rectangular and have a flat midsection 9, to which at each end, that is, as seen in the flow direction, there are adjoining diversion sections 10, 11. Diversion sections 10, 11 are flared in the direction to mold tube 1, and are arched in this instance. In this exemplary embodiment, diversion sections 10, 11 are identical, i.e. they are shaped like gutters.

The exact contour or radius of the gutter-shaped sections is preferably matched to the depth of cooling channels 7.

Cooling channels 7, in their inflow region and their outflow region preferably have a radius, in order to avoid turbulence in the cooling water flow upon entering into cooling channels 7.

This radius can also be used for the arched diversion sections.

What is claimed is:

1. A permanent chill mold for the continuous casting of metals, comprising: a mold tube (1) placed in a water box, wherein a water gap is formed between an inner side wall of the water box and an outer side (2) of the mold tube (1); and at least one sheet metal water deflector (3) situated in the water gap, wherein the mold tube (1) is supported at least in one direction to be laterally freely shiftable with respect to the water box and the working position of the mold tube (1) is adjusted by flow relationships in the water gap.

2. The permanent chill mold according to claim 1, wherein the mold tube (1) is correctly aligned in the water box in a self-centering manner.

3. The permanent chill mold according to claim 1, wherein at least a partial area of the outer surface (2) of the mold tube (1) is provided with cooling channels (7), and the sheet metal water deflector (3) is situated in an area of the cooling channels (7).

4. The permanent chill mold according to claim 2, wherein at least a partial area of the outer surface (2) of the mold tube (1) is provided with cooling channels (7), and the sheet metal water deflector (3) is situated in an area of the cooling channels (7).

5. The permanent chill mold according to claim 1, wherein the sheet metal water deflector (3) has a diversion section (10, 11) at an end thereof which is developed so that cooling water is conveyed from the water gap specifically into the cooling channels (7).

6. The permanent chill mold according to claim 2, wherein the sheet metal water deflector (3) has a diversion section (10, 11) at an end thereof which is developed so that cooling water is conveyed from the water gap specifically into the cooling channels (7).

7. The permanent chill mold according to claim 3, wherein the sheet metal water deflector (3) has a diversion section (10, 11) at an end thereof which is developed so that cooling water is conveyed from the water gap specifically into the cooling channels (7).

8. The permanent chill mold according to claim 4, wherein the sheet metal water deflector (3) has a diversion section (10, 11) at an end thereof which is developed so that cooling water is conveyed from the water gap specifically into the cooling channels (7).

9. The permanent chill mold according to claim 5, wherein the diversion section (10, 11) is configured to be arched.

10. The permanent chill mold according to claim 6, wherein the diversion section (10, 11) is configured to be arched.

11. The permanent chill mold according to claim 7, Wherein the diversion section (10, 11) is configured to be arched.

12. The permanent chill mold according to claim 3, wherein flow speed in the inflow region and the outflow region of the cooling channels (7) is increased by the sheet metal water deflector (10, 11).

13. The permanent chill mold according to claim 5, wherein flow speed in the inflow region and the outflow region of the cooling channels (7) is increased by the sheet metal water deflector (10, 11).

14. The permanent chill mold according to claim 9, wherein flow speed in the inflow region and the outflow region of the cooling channels (7) is increased by the sheet metal water deflector (10, 11).

15. The permanent chill mold according to claim 1, wherein sheet metal water deflectors (3) are situated in opposite regions of the mold tube (7).

16. The permanent chill mold according to claim 2, wherein sheet metal water deflectors (3) are situated in opposite regions of the mold tube (7).

17. The permanent chill mold according to claim 3, wherein sheet metal water deflectors (3) are situated in opposite regions of the mold tube (7).

18. The permanent chill mold according to claim 5, wherein sheet metal water deflectors (3) are situated in opposite regions of the mold tube (7).

19. The permanent chill mold according to claim 12, wherein sheet metal water deflectors (3) are situated in opposite regions of the mold tube (7).

* * * * *